United States Patent [19]

Blair et al.

[11] 4,030,158

[45] June 21, 1977

[54] HAIR BRUSH

[75] Inventors: Michael A. Blair; Robert M. Hoffman, both of Los Angeles, Calif.

[73] Assignee: Advance Design Laboratories, Inc., Los Angeles, Calif.

[22] Filed: June 3, 1976

[21] Appl. No.: 692,292

[52] U.S. Cl. ..... 15/159 A; 15/DIG. 5; 15/186; 132/11 R; D4/31

[51] Int. Cl.[2] ..... A46B 9/02

[58] Field of Search ..... 15/159 R, 159 A, 186–188, 15/DIG. 5; D4/31; 132/120, 85, 9, 11

[56] References Cited

UNITED STATES PATENTS

| | | | |
|---|---|---|---|
| 3,180,342 | 4/1965 | Dietsche | 132/120 |
| 3,727,260 | 4/1973 | Spydevold | 15/159 A |
| 3,949,765 | 4/1976 | Vallis | 132/11 R |
| 3,970,093 | 7/1976 | Lardenois | 132/9 |
| D127,983 | 7/1941 | Wechsler | D4/31 |

FOREIGN PATENTS OR APPLICATIONS

| | | | |
|---|---|---|---|
| 17,156 | 7/1897 | United Kingdom | 15/193 |

*Primary Examiner*—Peter Feldman
*Attorney, Agent, or Firm*—Kleinberg, Morganstern, Scholnick & Mann

[57] ABSTRACT

A hair brush, particularly useful for blow waving has a back of open frame construction to facilitate the flow of hot air. Folded single bristles are inserted into holes on the front surface of the brush in a staggered relatively uniform arrangement. The bristles are relatively thick in diameter and include a bead at one end to avoid scratching the scalp. The thickness of the bristles enables them to withstand the heat of the air used in blow waving.

3 Claims, 3 Drawing Figures

HAIR BRUSH

BACKGROUND OF THE INVENTION

Field of the Invention

The present invention relates to brushes, and more particularly, relates to a hair brush having a structure which renders it particularly useful for blow waving of hair.

In blow waving the brush is used to lift the hair away from the head while a stream of heated air is directed toward the roots of the uplifted strands of hair. This treatment, when applied to an appreciable portion of the hair results in a coiffure with "body," that is, having a thick or full consistency.

In accordance with the concepts of the present invention the blow waving technique establishes multiple desiderata for an effective blow waving brush. Such a brush must be able to withstand the heat of the applied air stream without melting and without softening excessively. This is particularly true of the bristles of the brush which, because of their low individual heat capacity are the portion of the brush most susceptible to thermal effects.

Further, it is desirable that a blow waving brush, (including its bristles) should not present unnecessary interference to the flow of the stream of heated air. Typically, the blow waving operator holds the brush in one hand and with the other hand applies the stream of hot air from a portable blower or hose. The back or block of the brush will be held in a blocking position in the air stream during an appreciable portion of the blow waving application. Because the brush is used to lift the hair while the air stream is directed upon the hair, it is desirable that the brush structure be constructed so as to avoid excessive blocking of the flow of air. This is especially true with respect to the flow of air through the back or block of the brush which would otherwise present a very large effective blocking cross-section to the flow of air through the brush and to the hair.

In order to avoid such blocking, it is desirable that the bristle portion of the brush have a relatively low density or cross-section of bristles as viewed from the back or block of the brush, consistent with satisfactory lifting of the hair.

On the other hand, as a brush is used blow waving, it is applied to the hair in a direction lateral to the brush and it is desirable, therefore, that the distribution of bristles as viewed from the side of the brush have a relatively high cross-sectional density. This can be accomplished by having the bristle distribution substantially uniform and without excessive gaps as viewed from the lateral direction. In this way, the brush will be most efficient for engaging the hair to lift it.

Certain other features are desirable in a brush. It should be easy to clean, and it should minimize scratching of the scalp tissues. Further, the brush should be inexpensive to manufacture and easy to assemble.

The prior Art

In U.S. Pat. No. Des. 127,983, Wechsler shows a ventilated brush having a number of bristle tufts inserted in holes in the block of the brush. The block of the brush has a number of straight slots or ventilating apertures through it. The full bristle tufts however frustrate the ventilating feature of the brush by blocking any flow of air through the back of the brush. Moreover, the straight slots or apertures extend laterally straight across the brush. The rows of holes into which the bristles are inserted are arranged in straight rows on the laterally extending ribs which define the laterally extending slots. As a result, the tufts of bristles are arranged in well defined rows with substantial gaps between the rows. These gaps, as described above, render the brush less efficient for lifting the hair during a blow waving application. Further, the individual small diameter bristles of which the tufts of bristles are formed would have very low heat capacity, and for that reason, if made of thermoplastic material, they would quickly become hot and lose their resiliency.

In U.S. Pat. No. 3,253,292, Herschensohn shows a ventilated block hair brush having a single purportedly flexible spine extending longitudinally along the brush. From this longitudinal spine, and integral with it, a number of fingers extend laterally. The front surface of the spine and fingers defines a plurality of holes into which bristle tufts are mounted. This brush is intended for stimulating the scalp by pulling on the hairs. The resistance of untangled and unknotted hair to the motion of the brush is said to cause the resilient spine of the brush to deform elastically laterally to such an extent as to sufficiently diminish the spacing between the fingers on the trailing edge of the brush, so as to cause the bristles to pinch the hair between them, increasing the pull on the hair.

The proposed pinching operation of the Herschensohn brush would be promoted by the use of a large number of bristles in each tuft, with each individual bristle having a rather small diameter, as is shown in the Herschensohn patent. However, in such tufts, the individual bristles lack the heat capacity they would have if their diameter were larger and are overly susceptible to softening during blow waving.

Commercially manufactured brushes are available which are purported to follow the teachings of the Herschensohn patent. They exhibit flexing in response to strong finger pressure, but exhibit no perceptible flexing in response to ordinary usage in hair. They do, however, because of the fragility of their central spine, present substantial breakage problems in production yield, shipping, handling and rough usage. These commercially available brushes are produced with individual bristles of relatively large diameter, which enables them to withstand heat. However, the bristles are arranged in rows which are only slightly curved and consequently, when viewed from the side, a number of gaps can be seen between the rows of bristles. The hair tends to slip through these gaps with the result that the effectiveness of the brush in lifting hair is impaired for blow waving applications.

SUMMARY OF THE DISCLOSURE

The brush of the present invention is particularly suitable for blow waving applications. The back of the brush has the form of a unitary open frame including a plurality of arcuate ventilating apertures extending laterally across the back of the brush. The collective areas of these arcuate apertures is an appreciable fraction of the total area of the block of the brush. In this manner, the brush block presents only the minimum necessary blockage of the air flow.

The surface of this brush frame contains a plurality of small holes on its front surface into which individual bristles are inserted. The small holes are staggered over the front surface to define a bristle distribution which as viewed laterally is generally uniform, has a relatively high cross-sectional density and is without excessive gaps. In this manner, the maximum gripping efficiency is achieved. At the same time, the bristles are aligned with the solid areas of the brush block so as to present a relatively low cross-sectional density as viewed through the back or block of the brush.

The front surface of the brush frame is arched about a longitudinally extending axis so that when the bristles are in place, the ends of the bristles lie in a convex surface. This enables the operator to enhance the lifting action of the brush by twisting his wrist as he draws the brush through the hair.

Instead of a tuft of small diameter bristles inserted into each of the holes in the front surface of the frame, the brush of the present invention makes use of a single bristle inserted in each hole. The diameter of the bristles used is somewhat larger than those used in ordinary brushes. This enhances the heat capacity of the individual bristles, resulting in a smaller temperature rise. As a result, the bristles, which are usually somewhat thermoplastic do not soften appreciably or lose their resiliency. In a preferred embodiment the bristles are formed with a bead at one end and are folded at a point closer to the opposite end. The fold is then inserted into the hole.

Because the brush uses fewer bristles which are aligned with the solid areas of the brush block, the bristles offer little resistance to the flow of air through the back or block of the brush.

The novel features which are believed to be characteristic of the invention, both as to organization and method of operation, together with further objects and advantages thereof, will be better understood from the following description considered in connection with the accompanying drawings in which several preferred embodiments of the invention are illustrated by way of example. It is to be expressly understood, however, that the drawings are for the purpose of illustration and description only and are not intended as a definition of the limits of the invention.

DESCRIPTION OF THE PREFERRED EMBODIMENT

Figure 3:
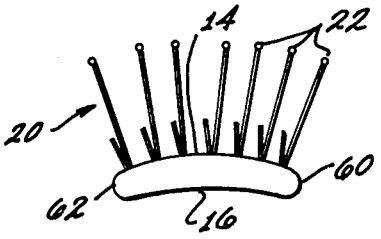
FIG. 3 is an end view of a preferred embodiment of the brush.
Figure 1:
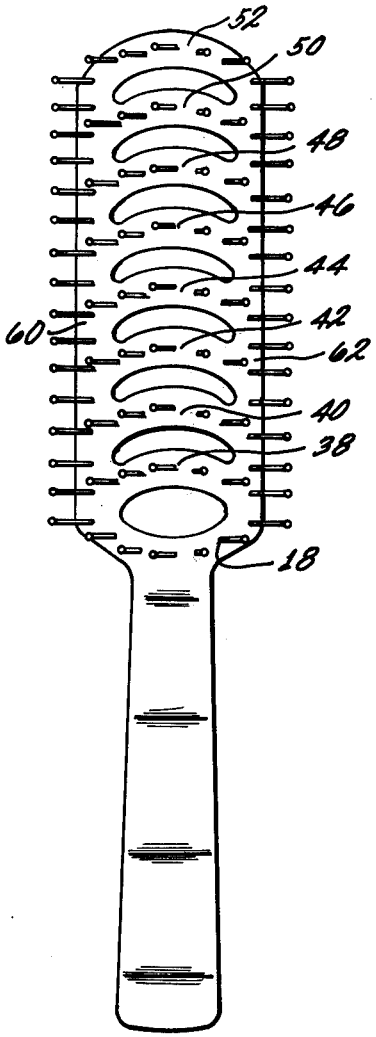
FIG. 1 is a front view of a preferred embodiment of the brush.
Figure 2:
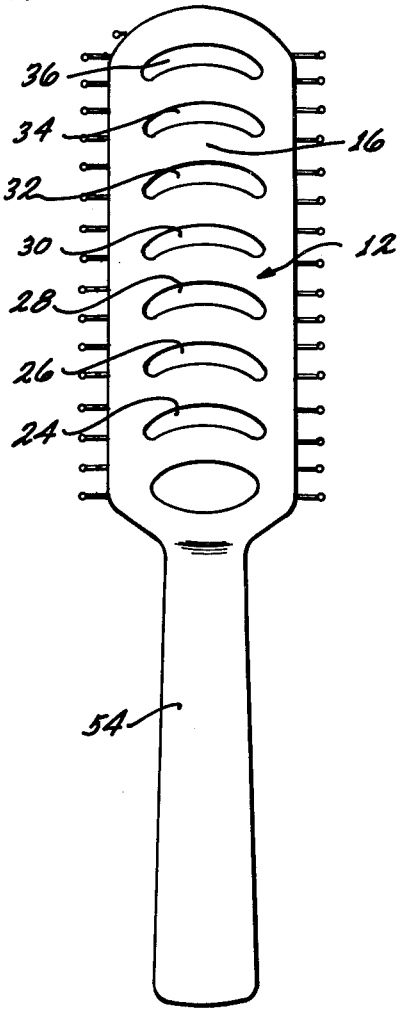
FIG. 2 is a back view of the preferred embodiment of the brush.

Referring now to the drawings, FIG. 1–3 show front, back and end views respectively of the preferred embodiment of the brush of the present invention. The brush comprises three main portions; a frame portion 12, a handle portion 54; and bristles 20.

The frame portion 12 defines a front surface 14 and a rear surface 16, as shown in FIG. 3. Frame 12 has longitudinally extendings members 60 and 62 on either side of it. These are connected by laterally extending arcuate rib-like frame members 38–52 which between them define apertures 24–36. This structure gives the brush great strength and rigidity; breakage problems associated with certain flexible brushes of the prior art have been eliminated. These apertures occupy an appreciable fraction of the area of the front surface 14 thus permitting air to flow readily through frame portion 12 of the brush. This is valuable where the brush is to be used for blow waving. Because of its open frame design, the brush is easy to clean.

As can be seen in FIG. 1, the front surface 14 of frame portion 12 is provided with a number of holes of which 18 is typical for anchoring the bristles to the frame portion.

Also, as can best be seen in FIG. 1, the distribution of holes 18 is substantially uniform over the front surface 14 and substantially devoid of gaps. Correspondingly, the pattern of the beaded tips of the bristles on their imaginary surface is also substantially uniform and devoid of gaps.

In the present invention tufts of bristles are not used. Instead, a single bristle is folded and the folded end is inserted into one of the holes of which 18 is typical. The bristles are formed with a bead at one end and are folded at a point closer to the opposite end. When a bristle has been inserted into its hole, there extends from the hole a longer portion with a bead on its end and a shorter portion without a bead. In this manner the density of bristles is greater near the front surface 14 of the frame portion 12, and the shorter ends of the bristles are useful for untangling snarls. The beads 22 at the ends of the bristles prevent the relatively thick and stiff bristles from scratching the scalp. The bristles used in the preferred embodiment measure about 1.2 millimeters in diameter and are of larger diameter than the bristles used in many ordinary hair brushes. The greater thickness results in greater heat capacity and as a result, at any time the temperature rise of the bristles is less than it would be if the bristles were smaller in diameter. As a result, the bristles do not soften or lose their resiliency.

As best seen in FIG. 3, the frame of the brush 12 is arched forward about an imaginary longitudinally extending axis. This is advantageous for the blow waving application in that the operator can enhace the hair lifting ability of the brush by twisting his wrist as he draws the brush through the hair. The beaded tips of the bristles thus lie on a imaginary convex surface.

A handle 54 of conventional design extends in a longitudinal direction from one end of frame portion 12 and forms a unitary structure therewith. In a preferred embodiment, the frame portion 12 and the handle portion 54 would be molded as a single piece of a plastic material, preferably of a type of plastic having a high thermosetting temperature, such as polypropylene. The bristle is formed from a strand of nylon. Because of the simplicity of the structure of the brush and the ease with which it can be assembled, the brush can be produced inexpensively.

Thus, there has been described a hair brush particularly suitable for use in blow waving applications. The brush has bristles of relatively large diameter substantially uniformly distributed over its front surface so that the spatial distribution of the tips of the bristles is substantially devoid of gaps. Each bristle is individually inserted into one of the holes in the frame of the brush. Because the brush has relatively few bristles which are aligned with the lateral ribs of the open frame structure of the brush, the brush and its bristles offers relatively little resistance to the free flow of air through the back of the brush.

The foregoing detailed description is illustrative of one embodiment of the invention, and it is to be understood that additional embodiments thereof will be obvious to those skilled in the art. The embodiments described herein together with those additional embodiments are considered to be within the scope of the invention.

What is claimed is:

1. A hair brush particularly for use in blow waving comprising:

a substantially rigid elongated plastic brush block having a front surface and a back surface and having an integral longitudinally extended handle extending from one end thereof, said brush block having a solid continuous peripheral rim having first and second substantially parallel side portions and first and second end portions and a plurality of substantially identical, substantially equally spaced, substantially parallel rib portions laterally joining said side portions of said rim, each of said parallel rib portions being sharply arched towards the same one of said end portions with the apex of its arch being positioned at the midpoint of each rib portion, said rib portions defining arcuate apertures therebetween for permitting air to be freely blown through said brush block.

a first plurality of folded plastic single bristles formed of thermoplastic material and mounted in the front surface of said brush block at substantially uniform spacing from each other around said peripheral rim of said block;

a second plurality of folded plastic single bristles formed of thermoplastic material, said second plurality of bristles being laterally unaligned with said first plurality of bristles and being mounted in the front surface of said block at substantially uniform spacings from each other along said sharply arched ribs and following the arch of said ribs to laterally subdivided the longitudinal spacing between said first plurality of brushes, whereby in a lateral projection of all of said bristles, the longitudinal spacing between bristles is substantially less than the spacing between said first plurality of bristles, and all the bristles present a much greater lateral surface area than the lateral surface area of said first plurality of bristles;

and each of said bristles being folded at a point beyond its midpoint to provide one long flexible strand and one shorter substantially stiffer strand.

2. The hair brush of claim 1 wherein each of said folded plastic single bristles is mounted in a corresponding individual socket hole in said brush block, and has a substantially constant diameter exceeding .5 millimeter, each of said plastic bristles having a rounded bead at one end thereof and being folded at apoint closer to the opposite end to provide one long flexible strand and one shorter substantially stiffer strand.

3. The hair brush of claim 2 wherein each of said folded plastic single bristles is formed of nylon.

* * * * *

UNITED STATES PATENT OFFICE

CERTIFICATE OF CORRECTION

Patent No. 4,030,158 Dated June 21, 1977

Inventor(s) MICHAEL A. BLAIR; ROBERT M. HOFFMAN

It is certified that error appears in the above-identified patent and that said Letters Patent are hereby corrected as shown below:

Column 6, line 8, cancel "subdivided" and insert --subdivide-- ;

Column 6, line 9, cancel "brushes" and insert --bristles-- .

Signed and Sealed this

*Second* Day of *September 1980*

[SEAL]

*Attest:*

SIDNEY A. DIAMOND

*Attesting Officer*

*Commissioner of Patents and Trademarks*